US011293715B1

(12) United States Patent
Newsome et al.

(10) Patent No.: US 11,293,715 B1
(45) Date of Patent: Apr. 5, 2022

(54) FIREARM TRIGGER MECHANISM

(71) Applicant: Heckler & Koch Inc., Columbus, GA (US)

(72) Inventors: Trenton Newsome, Waverly Hall, GA (US); Kevin Collins, Hamilton, GA (US); Pierce Osborn, Ellabell, GA (US)

(73) Assignee: Heckler & Koch Inc., Columbus, GA (US)

( * ) Notice: Subject to any disclaimer, the term of this patent is extended or adjusted under 35 U.S.C. 154(b) by 0 days.

(21) Appl. No.: 17/118,810

(22) Filed: Dec. 11, 2020

Related U.S. Application Data

(60) Provisional application No. 62/946,477, filed on Dec. 11, 2019.

(51) Int. Cl.

| | |
|---|---|
| ***F41A 19/12*** | (2006.01) |
| ***F41A 17/56*** | (2006.01) |
| ***F41C 23/04*** | (2006.01) |
| ***F41A 3/22*** | (2006.01) |

(52) U.S. Cl.
CPC ..... *F41A 19/12* (2013.01); *F41A 3/22* (2013.01); *F41A 17/56* (2013.01); *F41C 23/04* (2013.01)

(58) Field of Classification Search
CPC ..... F41A 19/00; F41A 19/12; F41A 19/16
See application file for complete search history.

(56) References Cited

U.S. PATENT DOCUMENTS

| | | | | |
|---|---|---|---|---|
| 1,699,881 | A * | 1/1929 | Elliott | F41A 19/16 42/69.02 |
| 2,388,149 | A * | 10/1945 | Humeston | F41A 19/12 42/69.01 |
| 2,549,904 | A * | 4/1951 | Hoard | F41A 19/16 42/69.02 |
| 2,559,010 | A * | 7/1951 | Cutler | F41A 19/16 42/69.02 |
| 4,908,970 | A * | 3/1990 | Bell | F41A 19/12 42/69.01 |
| 5,410,834 | A | 5/1995 | Benton et al. | |
| 6,560,909 | B2 | 5/2003 | Cominolli | |
| 6,907,813 | B2 | 6/2005 | Gablowski | |

(Continued)

FOREIGN PATENT DOCUMENTS

| | | | | |
|---|---|---|---|---|
| CH | 209660 | A * | 4/1940 | F41A 19/16 |

*Primary Examiner* — Joshua T Semick
(74) *Attorney, Agent, or Firm* — Wood Herron & Evans LLP

(57) ABSTRACT

A firearm with a compound lever trigger mechanism includes a first member pivotally attached to a firearm receiver at a first pivot and a first lever arm extending away from the first pivot attachment point to a sear. The first member is pivotable between a first position where the sear engages a firing element and a second position where the sear does not engage the firing element. A trigger member is pivotally attached to the first member first lever arm with a trigger blade arm extending away from the second pivot in one direction and a bearing arm extending away in another direction toward bearing contact with a surface of the receiver. Pulling the trigger blade arm causes the trigger member to pivot relative to the first member and the bearing arm to move in bearing contact against the receiver, thereby pivoting the lever arm from the first position to the second position.

8 Claims, 19 Drawing Sheets

(56) References Cited

U.S. PATENT DOCUMENTS

| | | | | |
|---|---|---|---|---|
| 7,451,564 | B2 | 11/2008 | Wait | |
| 7,743,543 | B2 | 6/2010 | Karagias | |
| 10,578,387 | B2 * | 3/2020 | Ostanin | F41A 19/16 |
| 2007/0186458 | A1 | 8/2007 | Wait | |
| 2011/0030261 | A1 | 2/2011 | Karagias | |
| 2014/0165444 | A1 | 6/2014 | Masters et al. | |

* cited by examiner

FIREARM TRIGGER MECHANISM

CROSS-REFERENCE TO RELATED APPLICATION

This application is a U.S. non-provisional patent application of U.S. Provisional Patent Application No. 62/946,477, filed on Dec. 11, 2019, the disclosure of which is hereby incorporated by reference herein in its entirety.

TECHNICAL FIELD

This invention relates to firearms, particularly to bolt-action precision rifles.

BACKGROUND

Precision rifles used for both sport and military purposes often have a manually operated bolt to load and extract cartridges to and from the barrel chamber. Cartridges are stripped from an internal fixed or removable magazine by forward movement of the bolt. The receiver, which houses the longitudinally reciprocating bolt, is typically mounted in a stock or chassis that provides a forearm, a butt stock, and a grip. Because a precision rifle often has a relatively long barrel, a folding stock allows the weapon to be stored in a more compact space or case.

SUMMARY

The present invention provides a precision rifle with multiple independent, novel features. These features include, but are not limited to, a trigger and safety mechanism, a folding stock latch, and a thumb rest integrated into the safety selector switch.

The trigger includes a compound lever mechanism with a first member pivotally attached to a firearm receiver at a first pivot and a first lever arm extending away from the first pivot attachment point to a sear. The first member is pivotable between a first position where the sear engages a firing element and a second position where the sear does not engage the firing element. A trigger member is pivotally attached to the first member first lever arm between the first pivot and the sear at a second pivot. The trigger member has a trigger blade arm extending away from the second pivot in one direction and a bearing arm extending away from the second pivot in another direction toward bearing contact with a surface of the receiver. When a user applies pulling force to the trigger blade arm, it causes the trigger member to pivot relative to the first member and the bearing arm to move in bearing contact against the receiver, thereby pivoting the lever arm from the first position to the second position.

The folding stock system includes a butt stock assembly pivotable between an extended position and a folded position with a latch mechanism. The latch mechanism is operable to selectively lock the butt stock assembly in the extended position and has a latch lever rotatable between open and locked positions with a tooth that engages a cammed socket. Moving the latch lever toward the locked position tensions the latch lever to bias the butt stock into the extended position without mechanical play.

The thumb rest is incorporated into a rotating safety selector. A thumb shelf is attachable to an external axial end of the safety selector.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
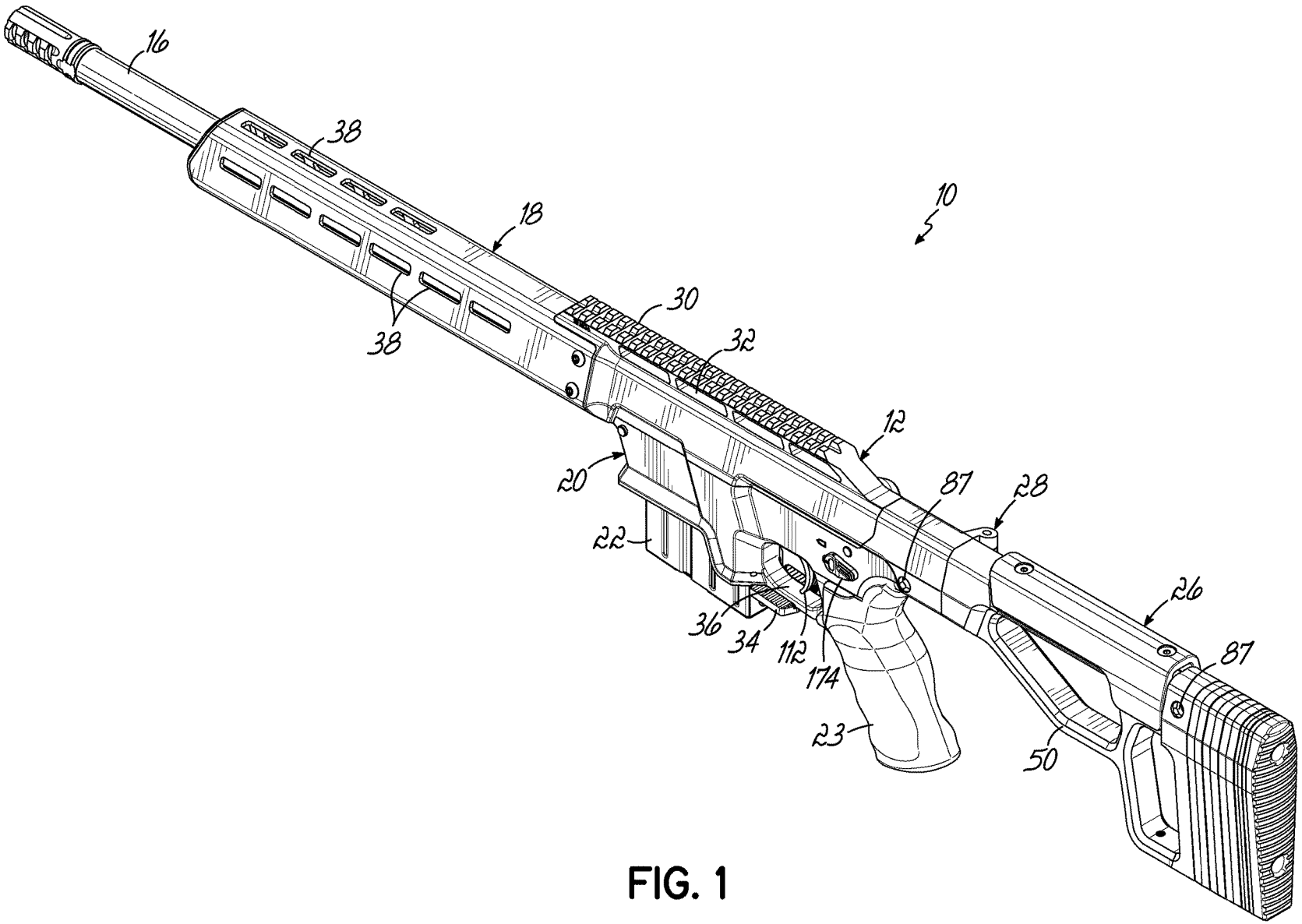
FIG. 1 is a first isometric view of a bolt-action rifle according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

"Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
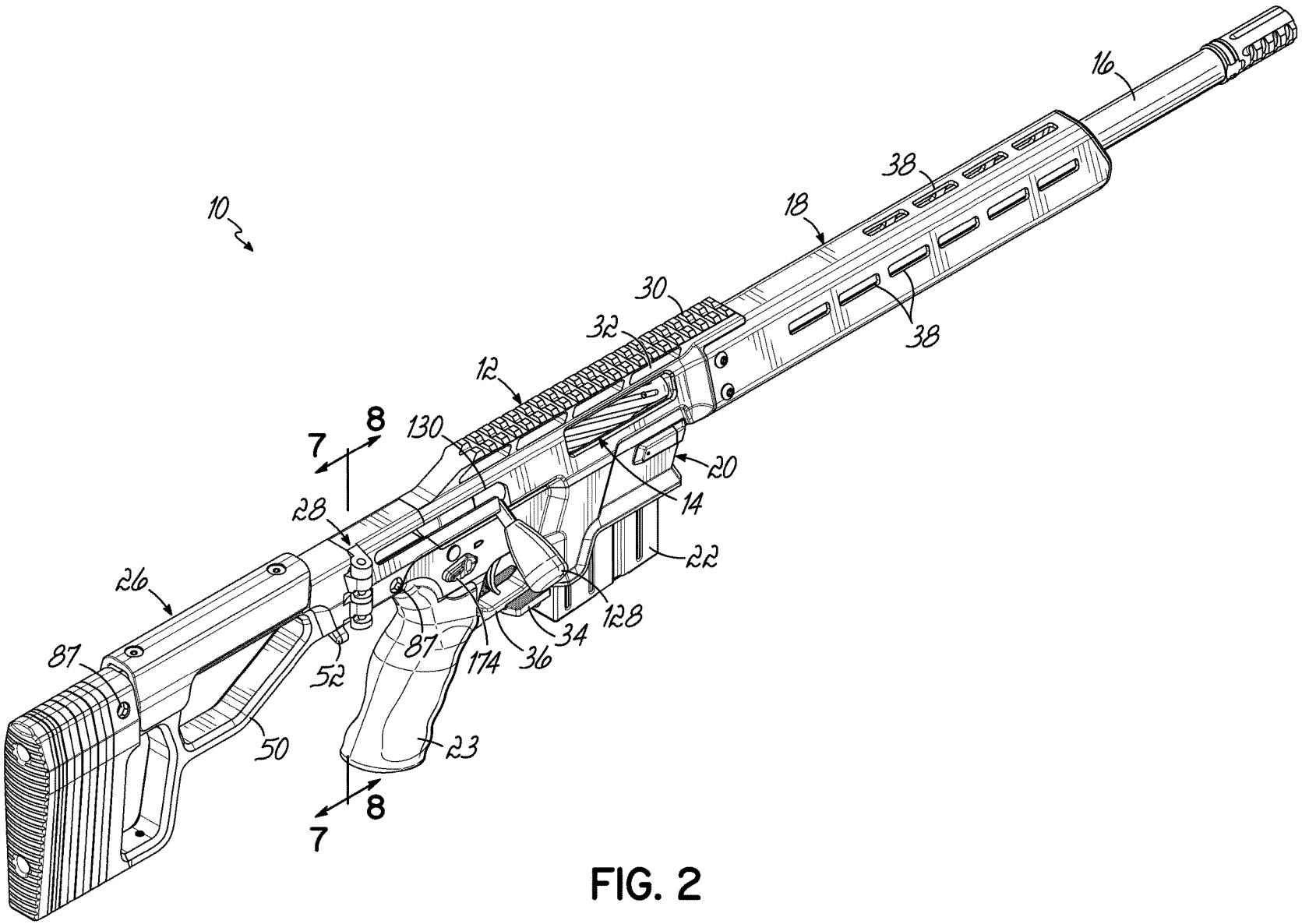
FIG. 2 is an alternate isometric view thereof.
Figure 4:
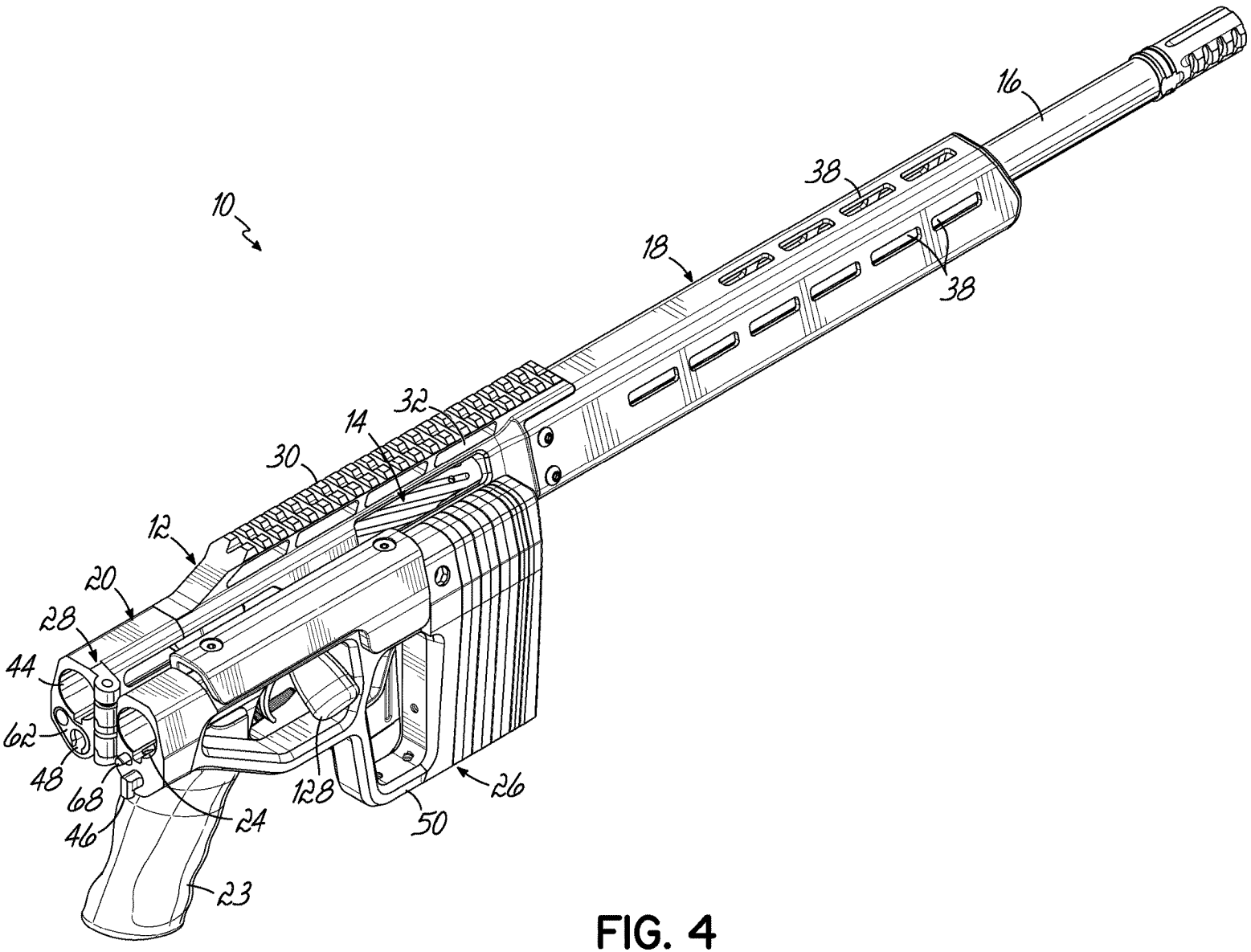
FIG. 4 is a similar view showing the stock in a side-folded position.

Referring first to FIGS. 1 and 2, therein is shown a precision bolt-action rifle 10 according to one embodiment of the present invention. The rifle 10 includes an upper receiver 12 which houses a bolt 14. A barrel 16 and forearm 18 or barrel shroud extends from a forward end of the upper receiver 12. Unlike many other bolt-action precision rifles, this rifle 10 does not mount in a chassis or stock. Instead, the upper receiver 12 is attached to a lower receiver 20. The fire control mechanism or trigger assembly is attached to the upper receiver 12 and extends into the lower receiver 20, which supports a detachable magazine 22, a handgrip 23, and butt stock 26. Referring now also to FIG. 4, according to a feature of one embodiment of the present invention, the lower receiver may include an integral hinge 28 that allows the butt stock 26 to fold to the side of the upper and lower receivers 12, 20.

The trigger housing or lower receiver 20 may be adapted to attach any of a variety of AR-pattern (or other pattern) handgrips selected by the user. The upper receiver 12 may also include an accessory attachment rail 30 for mounting optical aiming devices or other accessories. The rail 30 may include MIL-STD-1913 pattern lugs or other standardized accessory mounting rail configuration. The rail 30 may be elevated, as shown, to better position optical aiming devices. It may also include openings 32 to reduce weight, increase surface area, and ventilate the riser to better dissipate heat transferred to the upper receiver 12 from the barrel 18 and/or bolt 14.

The lower receiver 20 may include an ambidextrous magazine release 34 positioned near the trigger guard 36. The forearm 18 or barrel shroud can, if desired, be made from lightweight metal, a polymer material, or composite material. A material that shields or does not retain heat radiated from the barrel 16 may be desired. The forearm may mount directly to the upper receiver 12 and may include accessory mounting features 38 according to a standardized pattern, such as M-LOK™, KeyMod™, or one or more integral or attachable MIL-STD 1913 accessory rails.

Referring again to FIG. 3, the rifle 10 is shown in a field disassembly condition. The ammunition magazine 22 is removed from the lower receiver. Forward and rear takedown pins 120, 122 are displaced to the side to release forward and rear upper receiver lugs 124, 126 to allow the upper receiver 12 to separate from the trigger housing or lower receiver 20. The takedown pins 120, 122 can be captive in the lower receiver 20 by well-known means.

Figure 3:
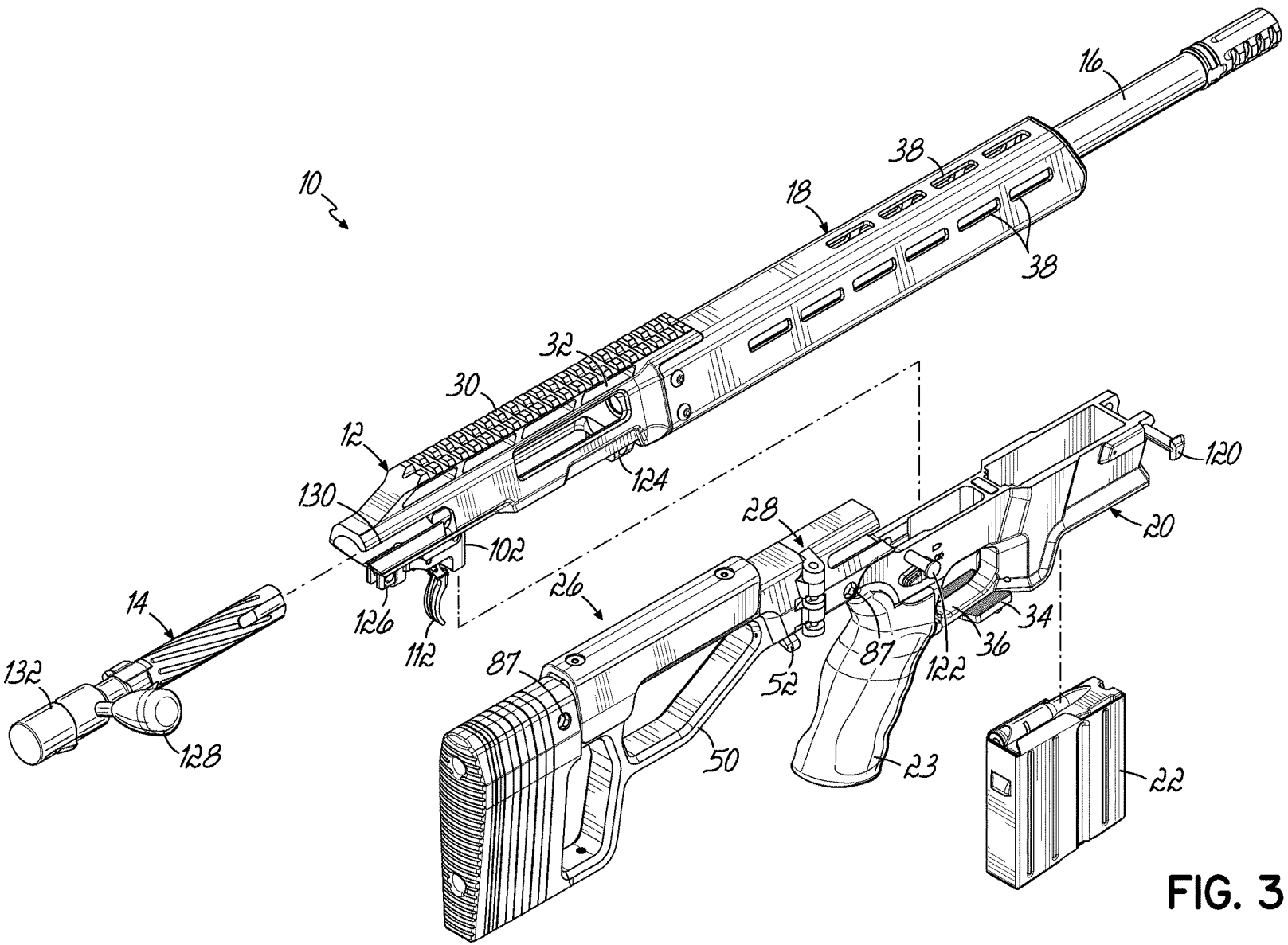
FIG. 3 is an isometric exploded view of the rifle in a field disassembly condition.

When the upper receiver 12 is disassembled from the lower receiver 20, the bolt 14 may be removed from the rear of the upper receiver 12. When assembled, as shown in FIG. 2, the bolt handle 128 may be slid along a slot 130 in the upper receiver 12 that extends rearward into a rear portion of the lower receiver 20 to allow the bolt 14 to fully open. When disassembled, as shown in FIG. 3, the slot 130 is open to the rear, allowing the bolt 14 to be removed.

Figure 5:
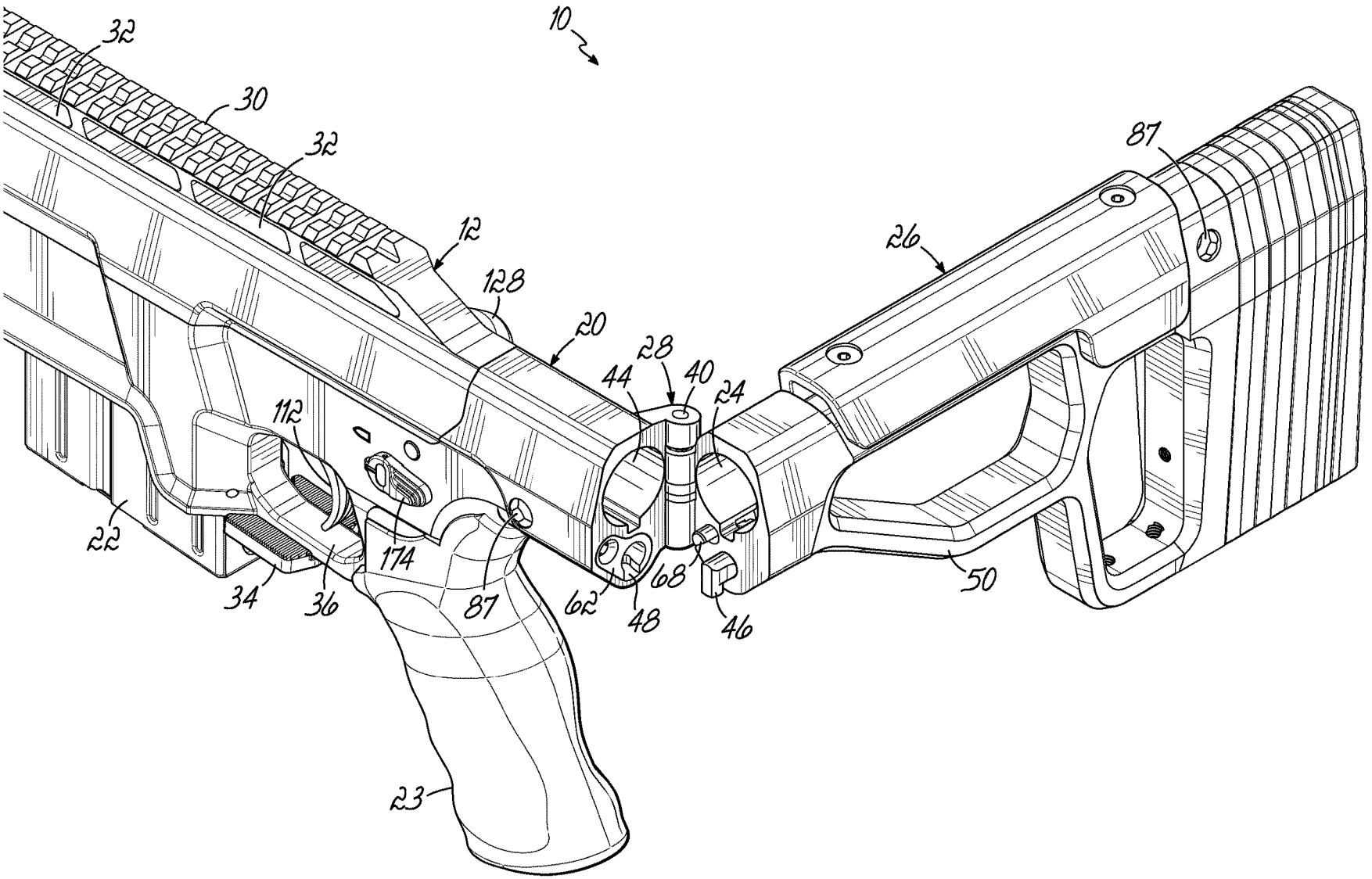
FIG. 5 is a fragmentary isometric view showing the hinge of the butt stock in a partially open or partially folded position.
Figure 6:
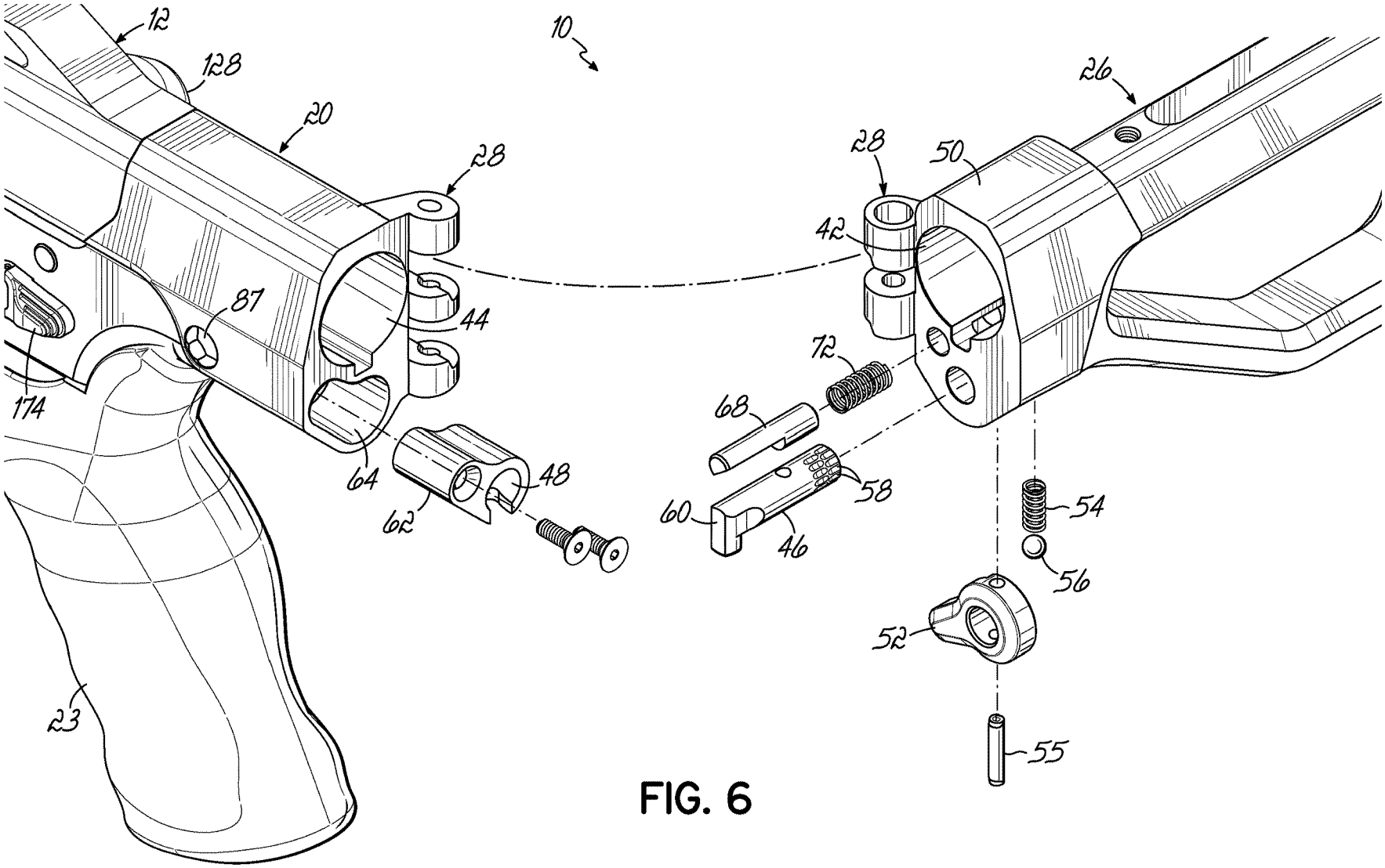
FIG. 6 is a similar view with latch parts shown exploded.
Figure 8:
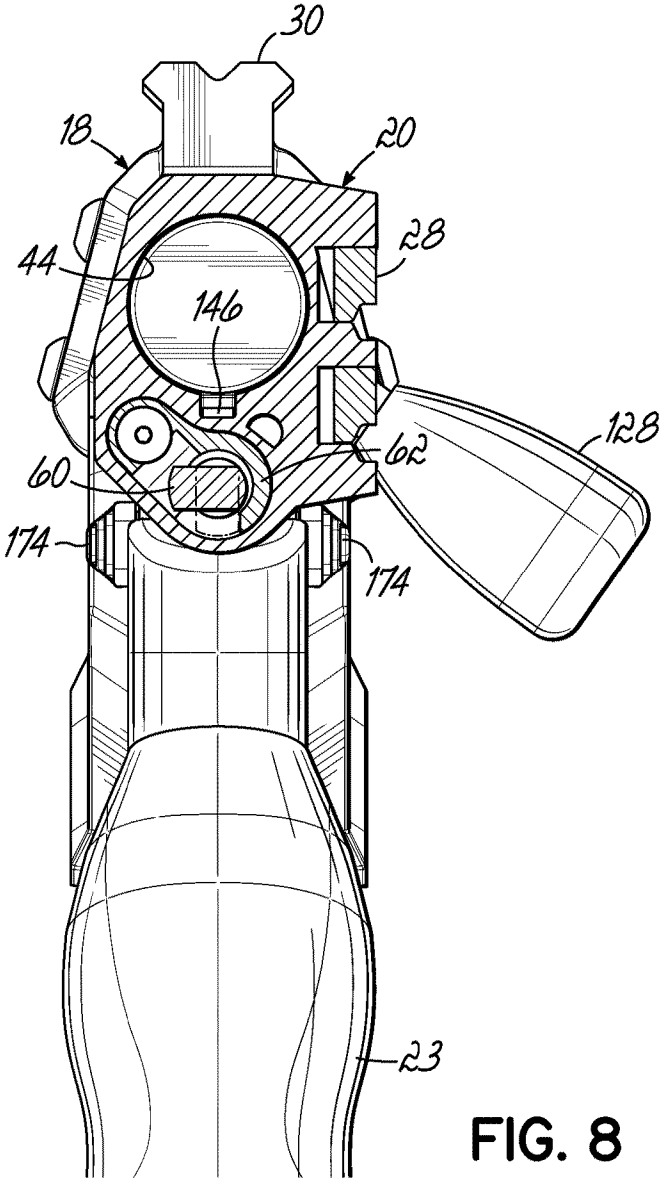
FIG. 8 is a cross-sectional view toward the front taken substantially along line 8-8 of FIG. 2.
Figure 7:
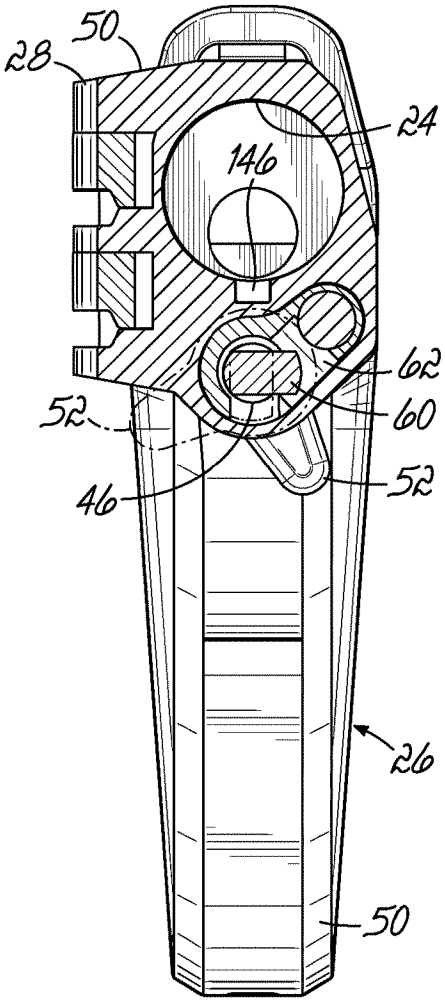
FIG. 7 is a cross-sectional view toward the rear taken substantially along line 7-7 of FIG. 2.
Figure 9:
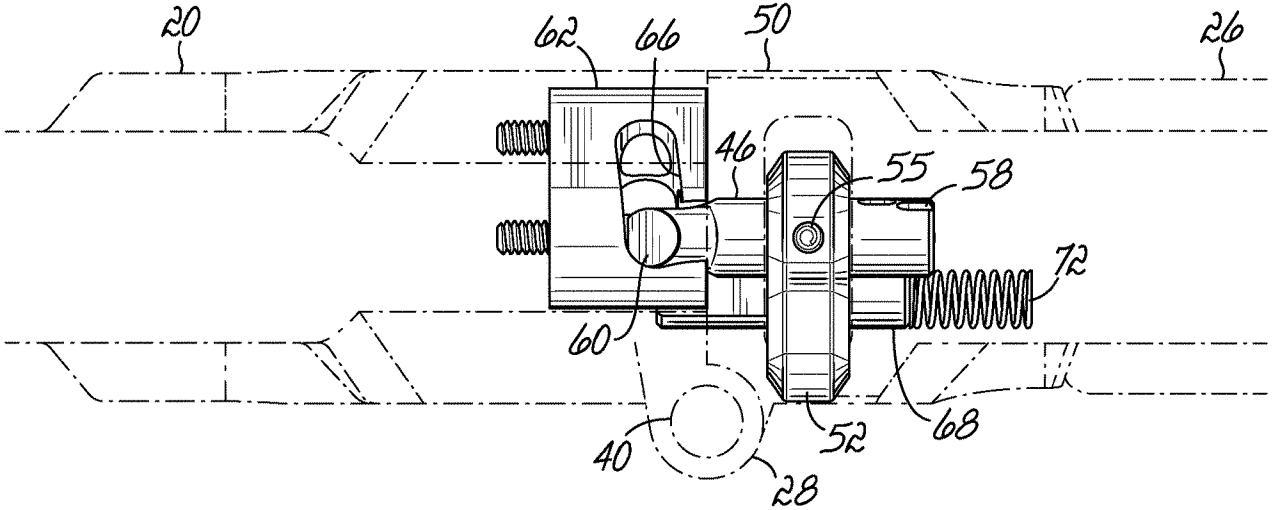
FIG. 9 is an isolated bottom view of latching components shown in an unlocked condition.
Figure 10:
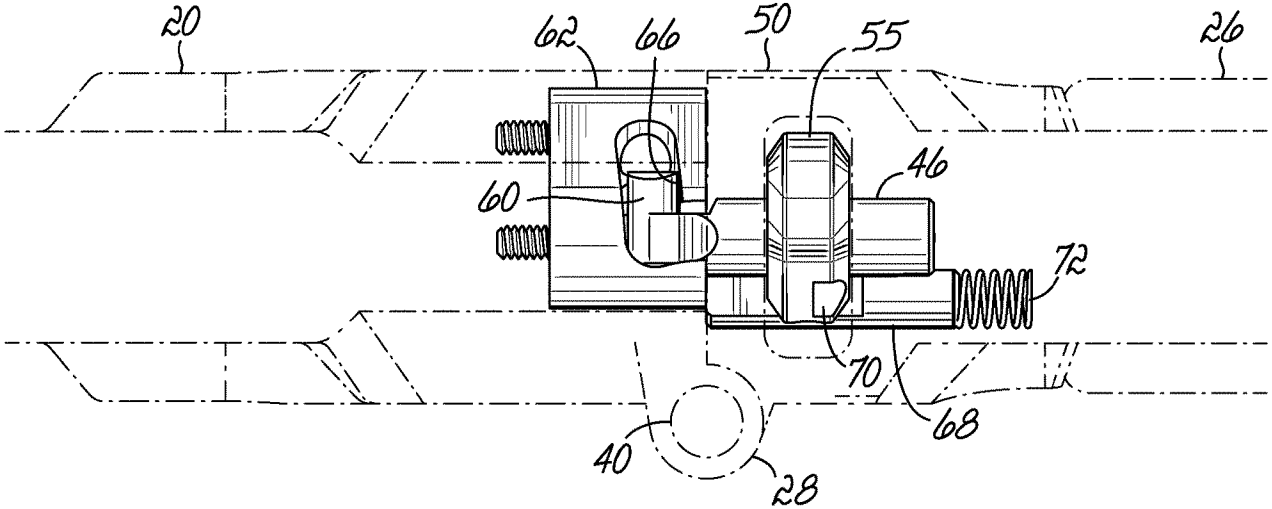
FIG. 10 is a similar view showing the components in a locked position.

Referring now to FIGS. 5 and 6, therein is shown an integral hinge 28 connecting a rear portion of the lower receiver 20 to the butt stock 26 in a way that allows it to be firmly locked in an extended position, yet easily folded to the side for more compact storage or transportation of the rifle 10. The hinge 28 provides a knuckle that pivots on a hinge pin 40.

In the illustrated embodiment, the butt stock 26 includes a substantially cylindrical bore 24 that, when in the extended position, axially aligns with another bore 44 within a rear portion of the lower receiver 20 to accommodate rearward reciprocation of the bolt 14 beyond the upper receiver 12. Unlike an automatic action firearm, a bolt-action firearm does not include a recoil spring, which is often housed behind the bolt or a bolt carrier assembly and may extend into a butt stock.

In the illustrated embodiment, a rotatable latch member 46 mounted on the butt stock 26 engages a socket 48 in the rear of the lower receiver 20, allowing the butt stock 26 to be firmly locked in the extended position. The latch member 46 may be mounted in a body portion 50 of the butt stock 26 and actuated manually by a lever 52 secured to the latch member 46 using a roll pin 55. The rotational position of the latch member 46 may be held by a spring-biased ball detent 54, 56 that engages detent grooves 58 on the body of the latch member 46.

A hook portion 60 of the latch member 46 will engage the socket 48 when pivoted to the closed position. The socket 48 may be formed in an insert piece 62 fitted into a cavity 64 in the rear end of the lower receiver 20. The insert piece 62 and latch member 46 may be made of a material, such as steel, that is relatively harder and more durable than the materials used for the lower receiver 20 and/or body portion 50 of the butt stock 26.

Referring now also to FIGS. 7-10, the hook portion 60 of the latch member 46 can enter the non-round socket 48 and then rotate to engage an inner cam surface 66. The cam surface 66 can be configured to provide an increasing amount of tension as the latch member 46 is rotated toward the engaged or locked position. This assures a firm lock up between the butt stock 26 and lower receiver 20, eliminating any play or rattle in the hinged interface.

Figure 11:
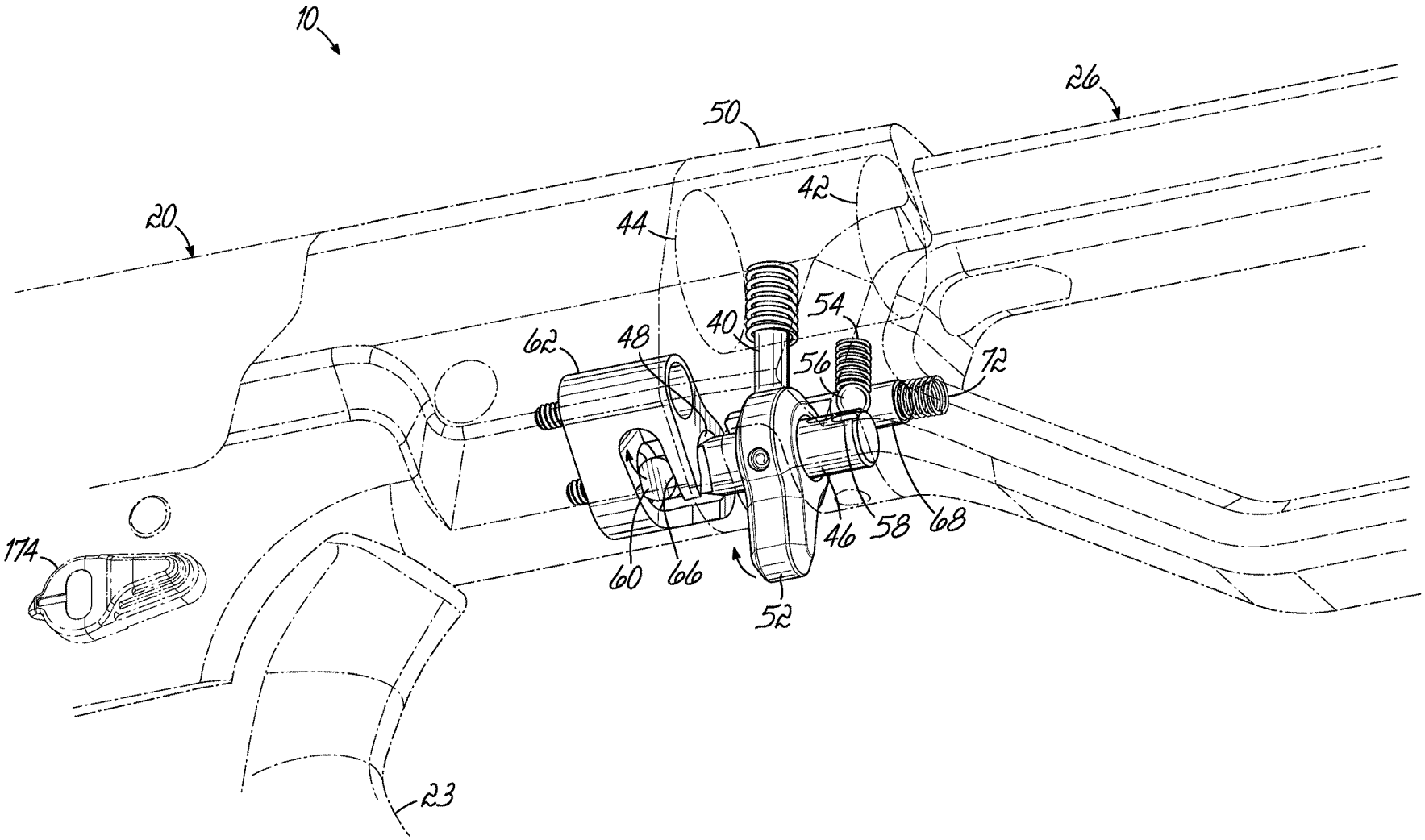
FIG. 11 is an isometric isolated view of the latch components shown in a partially locked position with the lower receiver and butt stock environment shown in phantom.
Figure 13:
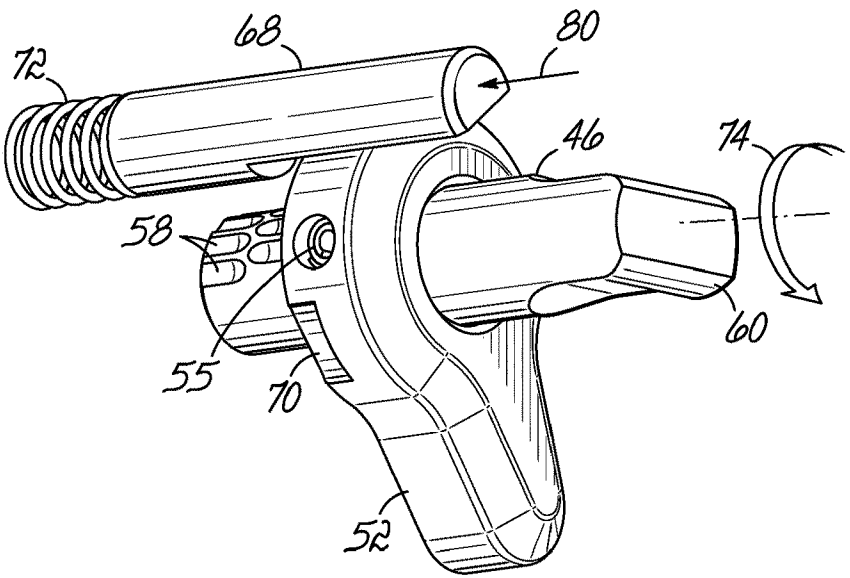
FIG. 13 is a similar view showing the anti-rotation plunger in the unlocked position, allowing the latch to rotate.
Figure 12:
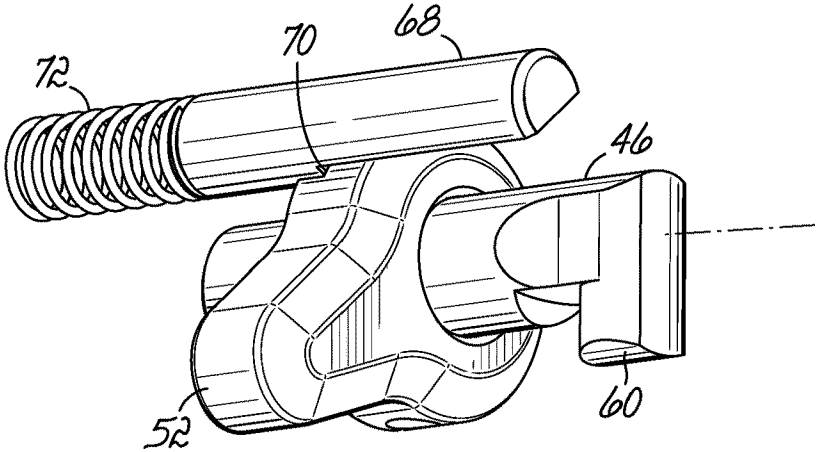
FIG. 12 is another isometric isolated view of the latch and anti-rotation plunger in a locked position.

Referring now also to FIGS. 11-13, when the latch member 46 is in a latched position with the hook portion 60 bearing against the cam surface 66, this frictional engagement maintains the latch member 46 firmly in the secured position. When the latch member 46 is rotated to the unlatched position, the butt stock 26 is allowed to pivot on the hinge 28. When moving the butt stock 26 back to the extended position, the latch member 46 must be in the unlatched position in order for the hook portion 60 to enter the socket 48. Although the detent ball 56 generally retains the position of the latch member 46, the lever 52 could be inadvertently bumped, moving the latch member 46 into a position where it will not enter the socket 48 when the butt stock 26 is extended. In order to hold the latch member 46 in the unlocked position whenever the hinge 28 is open, a locking plunger 68 carried by the body portion 50 of the butt stock 26 can engage a notch 70 on the lever 52, as shown in FIG. 12. The locking plunger 68 is biased by a spring 72 toward this locked position and will slide along the lever 52 until aligned with the notch 70.

With reference now also to FIG. 5, as the hinge 28 is closed, moving the butt stock 26 toward the extended position, an extension of the locking plunger 68 contacts a rear surface of the lower receiver 20 causing it to be displaced against the spring 72, as shown by arrow 80, as illustrated in FIG. 13. When the locking plunger 68 is disengaged from the notch 70, the latch member 46 and lever 52 are released to be rotated toward the latched position (as illustrated by arrow 74 in FIG. 13). This mechanical action operates automatically without user assistance.

The butt stock 26 and/or lower receiver 20 may include one or more sling attachment features 87. In the illustrated embodiment, the attachment features 87 are, by way of example, recesses for quick-release attachment of a single point sling swivel.

Figure 14:
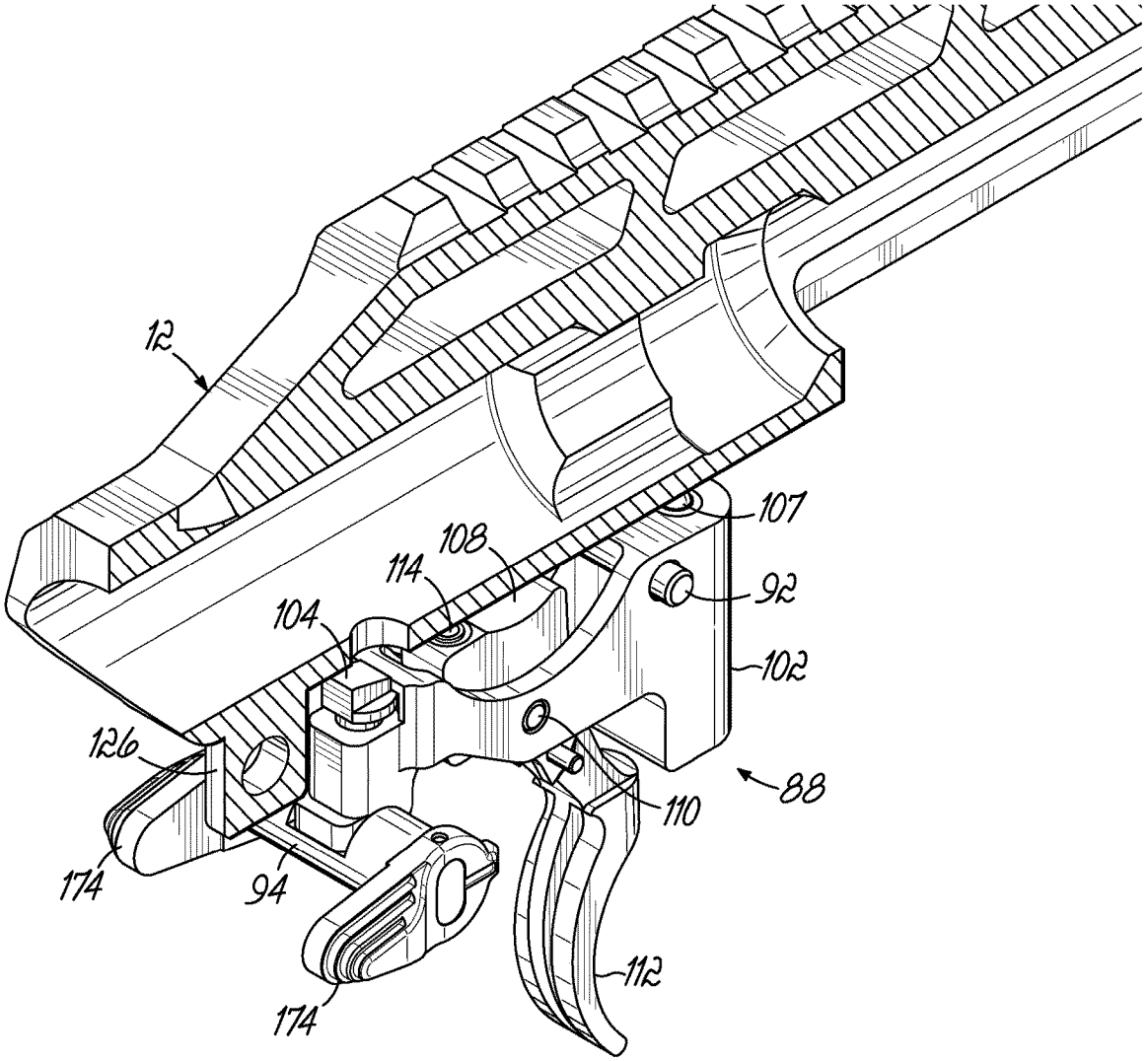
FIG. 14 is an isometric view of a trigger mechanism according to an embodiment of the present invention shown with a partially cut-away upper receiver for clarity and the safety selector, which is housed in the lower receiver.
Figure 15:
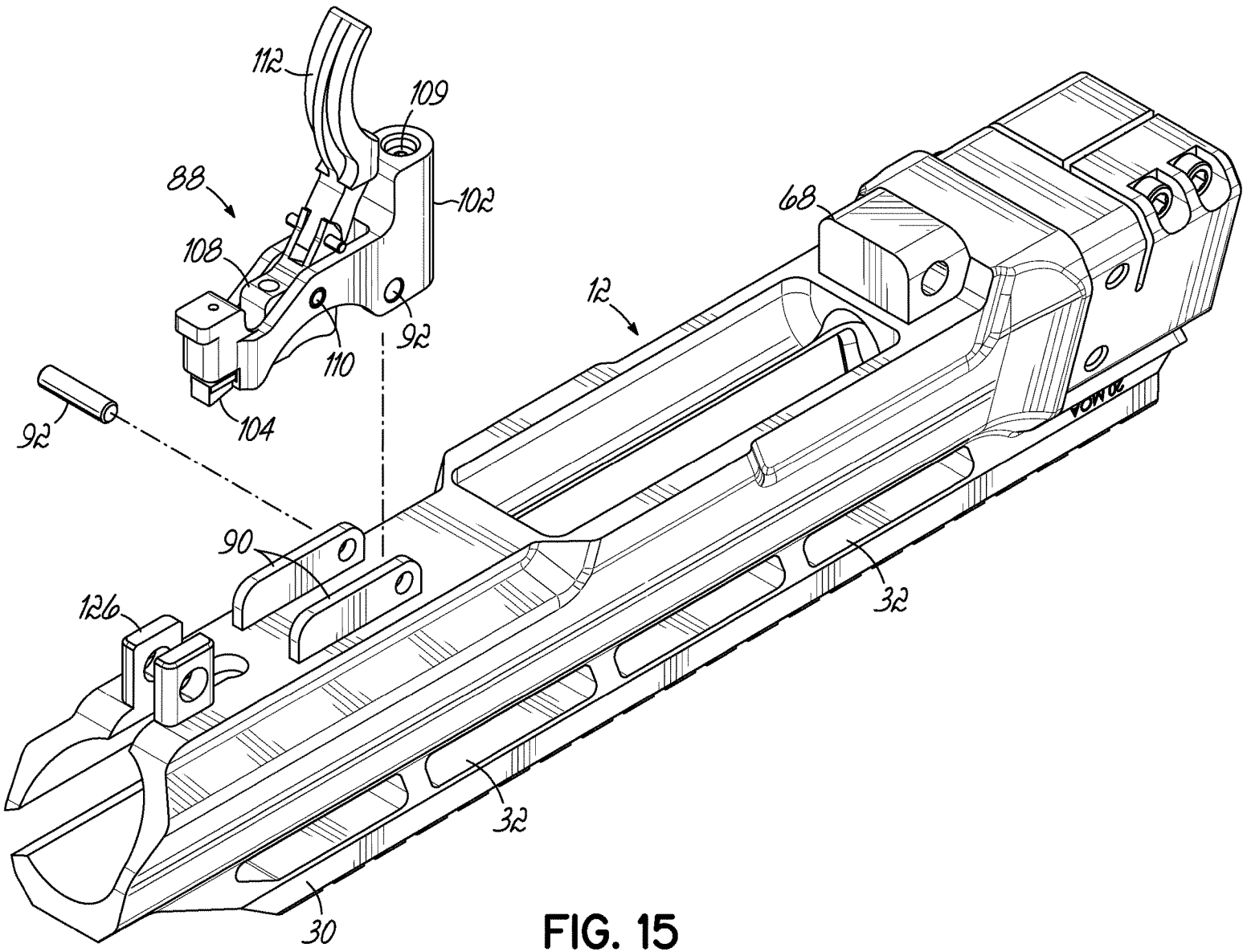
FIG. 15 is an inverted isometric exploded view of the upper receiver, trigger mechanism, and mounting pin.
Figure 16:
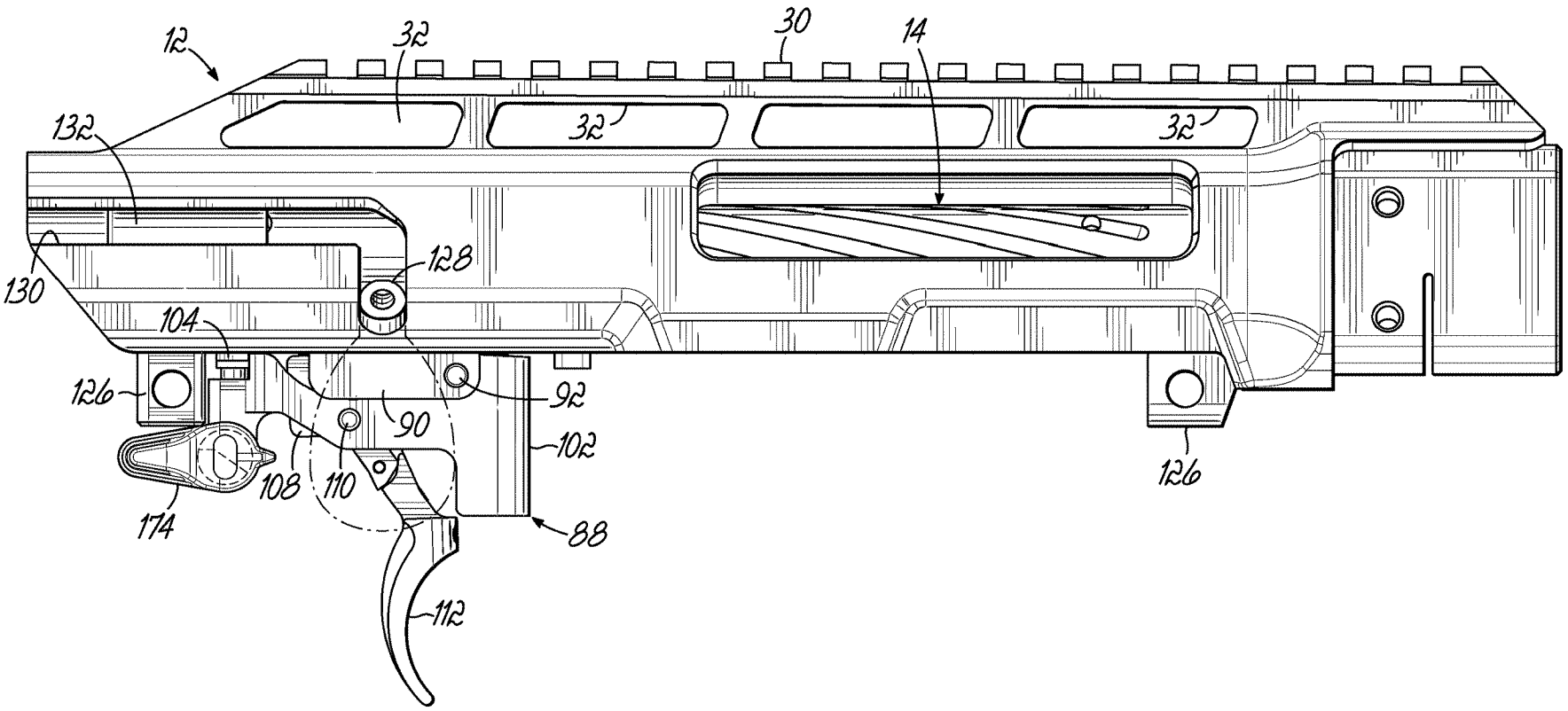
FIG. 16 is a side elevation view of a barreled action including an upper receiver, trigger mechanism, bolt assembly.

Referring now to FIGS. 14-16, a fire control mechanism 88 provides a compound lever mechanism to increase mechanical advantage and movement. It attaches to a pair of laterally spaced apart mounting lugs or flanges 90 on the bottom side of the upper receiver 12 using a single sear carrier pivot pin 92. The safety selector 94 is shown in FIGS. 14 and 16-18 to provide context, but it is rotatably mounted in transversely opposed openings 95 in the lower receiver 20. The safety selector 94 is shown in the safe position in FIGS. 14, 16, and 17, and it is shown in the fire position in FIGS. 18 and 19.

Figure 17:
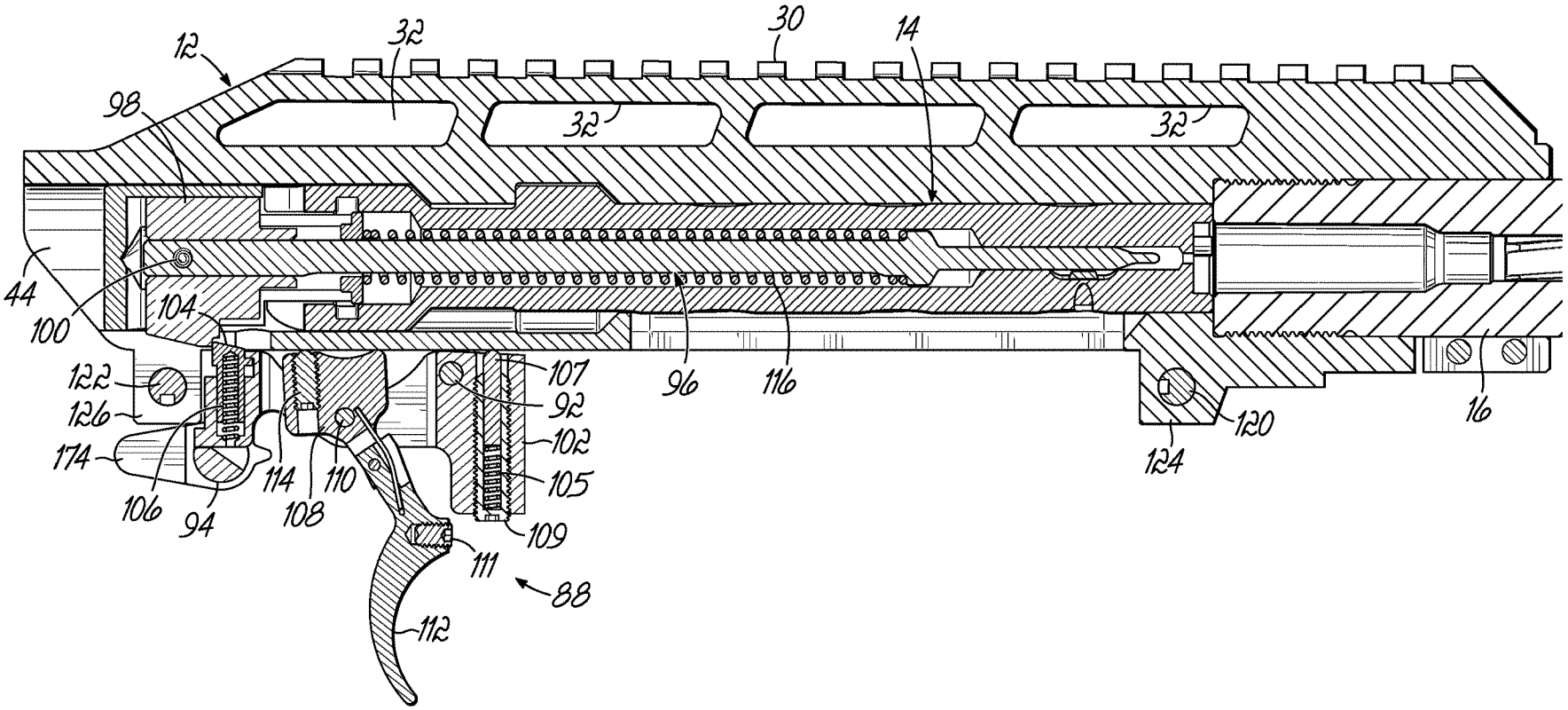
FIG. 17 is a side longitudinal sectional view (with the ammunition magazine and lower receiver assembly removed) showing is the trigger mechanism and bolt assembly in a cocked condition.

Referring now also to FIG. 17, this view shows the bolt 14 in an in-battery position. Inside the bolt 14 is a firing element in the form of a striker or firing pin 96 attached to a cocking piece 98, such as with a transverse roll pin 100. The firing pin assembly 96, 98, 100 is shown in a cocked position in FIG. 17. The fire control mechanism 88 includes a sear carrier 102 pivotally secured to the flanges 90 of the upper receiver 12 by a pivot pin 92 and carrying a displaceable sear 104 biased into an extended position by an internal coil spring 106. The required pull force (pull weight) of the trigger mechanism can be set by an adjustable trigger spring 105 that biases a plunger 107 against a bottom wall of the upper receiver 12. The spring tension may be adjusted by a threaded sleeve 109 in the sear carrier 102 that carries the spring 105 and plunger 107. A trigger body 108 is pivotally mounted via a pivot pin 110 to the sear carrier 102. The trigger body 108 includes a trigger leg 112, the shape or style of which may vary depending on user preference. An opposite extension of the trigger body 108 includes an adjustable bearing ball point 114 that bears against a bottom wall of the upper receiver 12.

Figure 20:
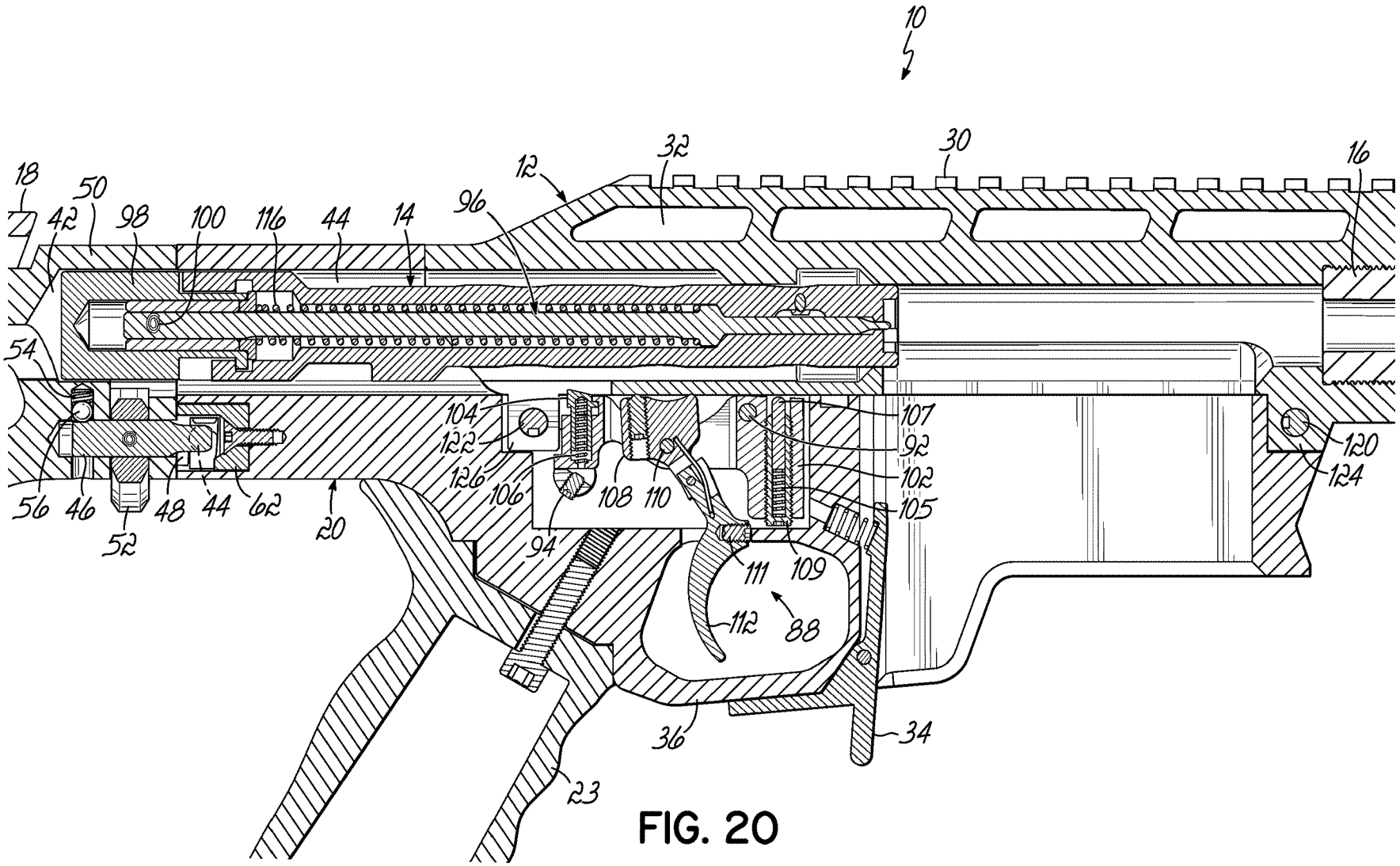
FIG. 20 shows a side elevation longitudinal sectional view as the bolt is being moved to the rear, depressing the sear with the safety selector in the safe position.

The sear 104 engages the cocking piece 98 in this position and prevents release of the firing pin 96. The trigger spring 105 biases the members of the fire control assembly 88 toward the "reset" or "cocked" position (FIG. 17). The forward travel (i.e., "reset" position) of the trigger leg 112 may be adjusted by a set screw 111 that contacts a surface of the lower receiver 20 inside the trigger guard (as shown in FIG. 20). In this embodiment, the sear carrier pivot pin 92 is the only fixed point of connection between the fire control mechanism 88 and the upper receiver 12 and the only fixed pivot point of the sear carrier 102 and trigger body 108. Additionally, the fire control mechanism 88 does not require any additional housing or frame to support any other fixed pivot points, as is the case with most trigger mechanisms for bolt-action firearms.

Figure 18:
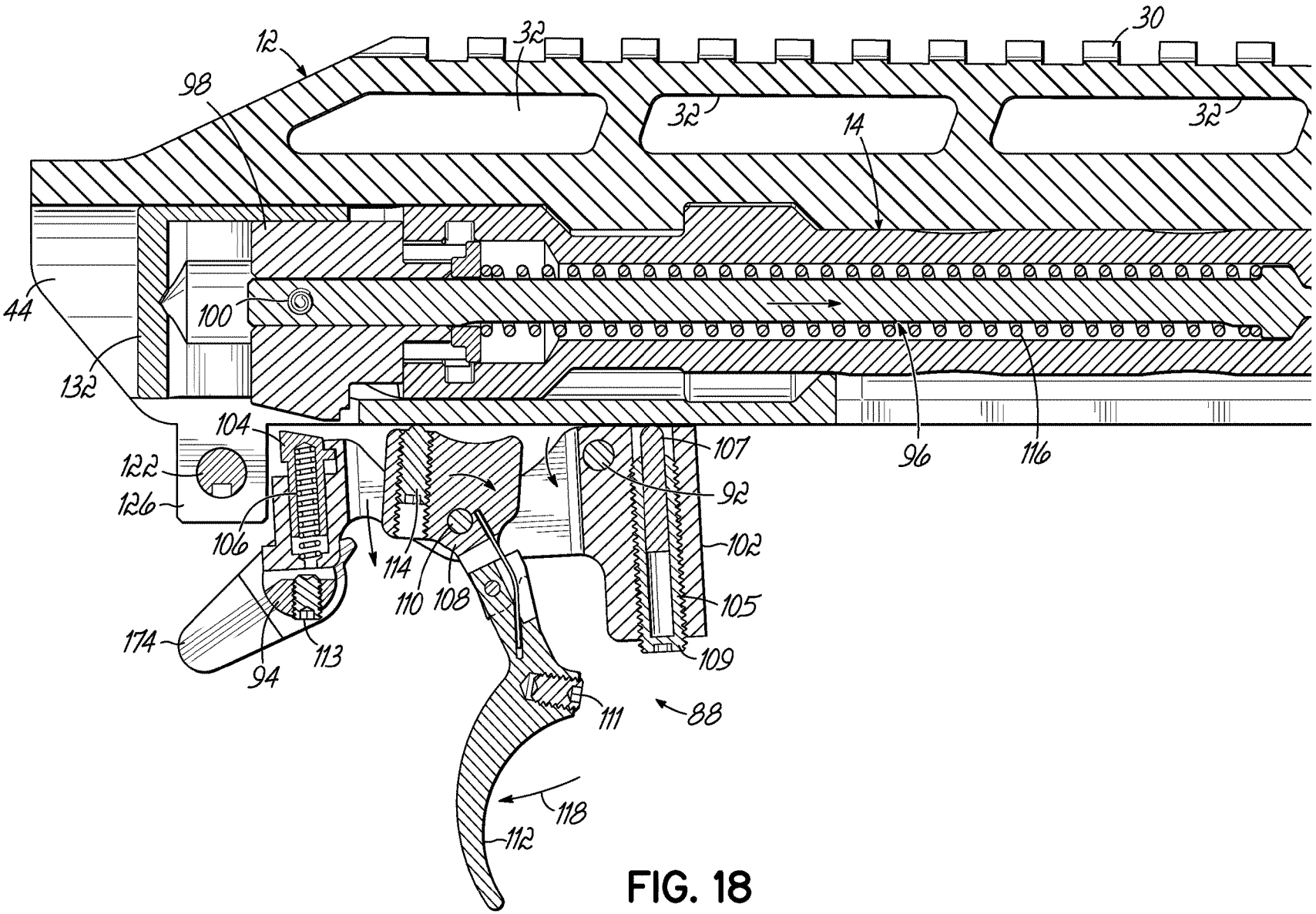
FIG. 18 shows an isometric isolated view of the bolt assembly and trigger assembly in the cocked condition, and the safety selector in the fire position.

Referring now to FIG. 18, therein the safety selector 94 is shown in a "fire" position, the fire control mechanism 88 is shown in a "pulled" position, and the firing pin assembly 96, 98, 100 is shown in a "released" position. The firing pin assembly 96, 98, 100 has been released and shifted forward by the firing pin spring 116. The fire control mechanism 88 provides a compound lever system with a sliding fulcrum and/or fixed and moving pivot points. As illustrated, the trigger leg 112 has been pulled to the rear, as shown by arrow 118. This causes the trigger body 108 to rotate on its pivot pin 110 relative to the sear carrier 102. The upper extension of the trigger body 108 is leveraged against the bottom wall of the upper receiver 12 with the ball point 114 acting as a sliding bearing surface. The extension of the ball point 114 may be adjusted by rotation of its threaded socket in the sear carrier 102. Leverage of the trigger body 108 against the bottom surface of the receiver 12 and its pivot 110, in turn, causes it to rotate on its pivot pin 110, as shown by arrows in FIG. 18. The ball point 114 provides a sliding fulcrum against which the trigger body 108 displaces its pivotal connection to the sear carrier 102. This, in turn, rotates the sear carrier 102 on its fixed-location pivot pin 92, lowering the sear 104, and releasing the cocking piece 98. The distance (radius) of the sear 104 from the pivot pin 92 of the sear carrier 102 is greater than that of the trigger body pivot 110, causing the sear 104 to be moved a greater distance than the trigger body pivot 110 when the trigger is pulled. The length of the trigger leg 112 from the ball point 114 may be greater than that of the trigger body pivot 110. Thus, an appropriate force and length of trigger pull is compounded to produce the appropriate amount of force and sear movement to release the firing element (i.e., cocking piece 98 of the firing pin 96).

As shown in FIG. 18, when the safety selector 94 is moved to the "fire" position, the rearward end of the sear carrier 102 that holds the sear 104 is allowed to move downward a sufficient distance to release the firing pin assembly 96, 98, 100. In the "safe" position (FIG. 17), the safety selector 94 blocks downward pivotal movement of the rear end of the sear carrier 102. FIG. 18 also depicts an adjustable set screw 113 that can be adjusted on the safety selector 94 to limit travel of the sear carrier 102 (and trigger 108, 112).

Figure 19:
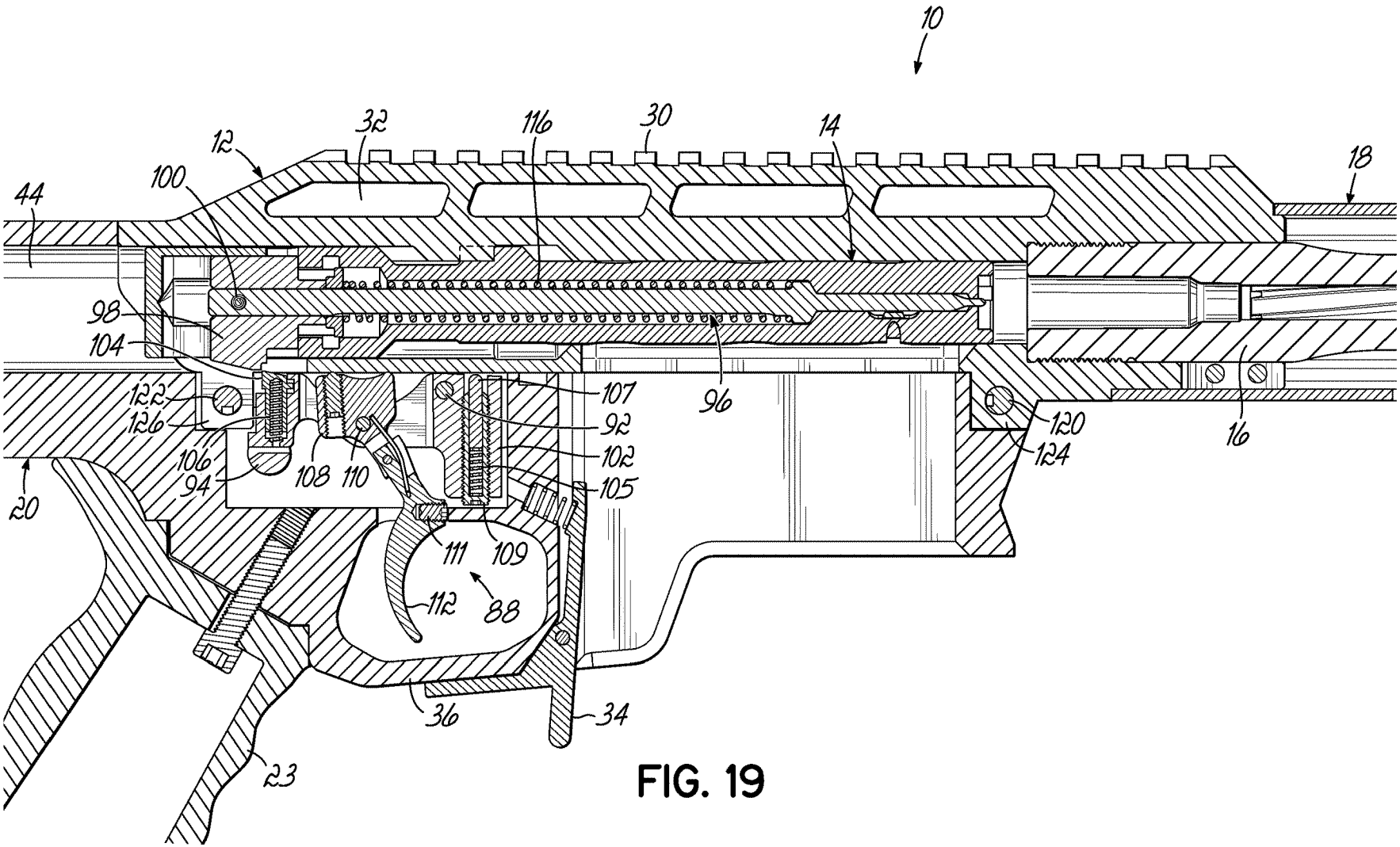
FIG. 19 is a side longitudinal sectional view showing the safety selector in the fire position, trigger mechanism in a pulled condition, and firing pin of the bolt assembly in the released position.

Referring now to FIG. 19 (which shows the lower receiver 20), after firing (release of the firing pin 96) and return of the fire control mechanism 88 to its "reset" position, the bolt 14 and firing pin assembly 96, 98, 100 can be retracted. The bolt can be retracted without resetting the trigger. As the catch tooth of the cocking piece 98 passes the sear 104, the sear 104 can be displaced or deflected against its spring 106 without causing (or requiring) movement of the sear carrier 102. This allows the bolt 14 and firing pin assembly 96, 98, 100 to be retracted without regard to whether the safety selector 94 is in the "safe" or "fire" position.

FIG. 20 shows the bolt 14 and firing pin assembly 96, 98, 100 in a fully retracted position. In this position, the bolt extends rearwardly beyond the upper receiver 12 into an extension bore 44 of the lower receiver 20 and can extend into a bore 42 of the butt stock body 50 when the butt stock 26 is in the extended position.

Figure 21:
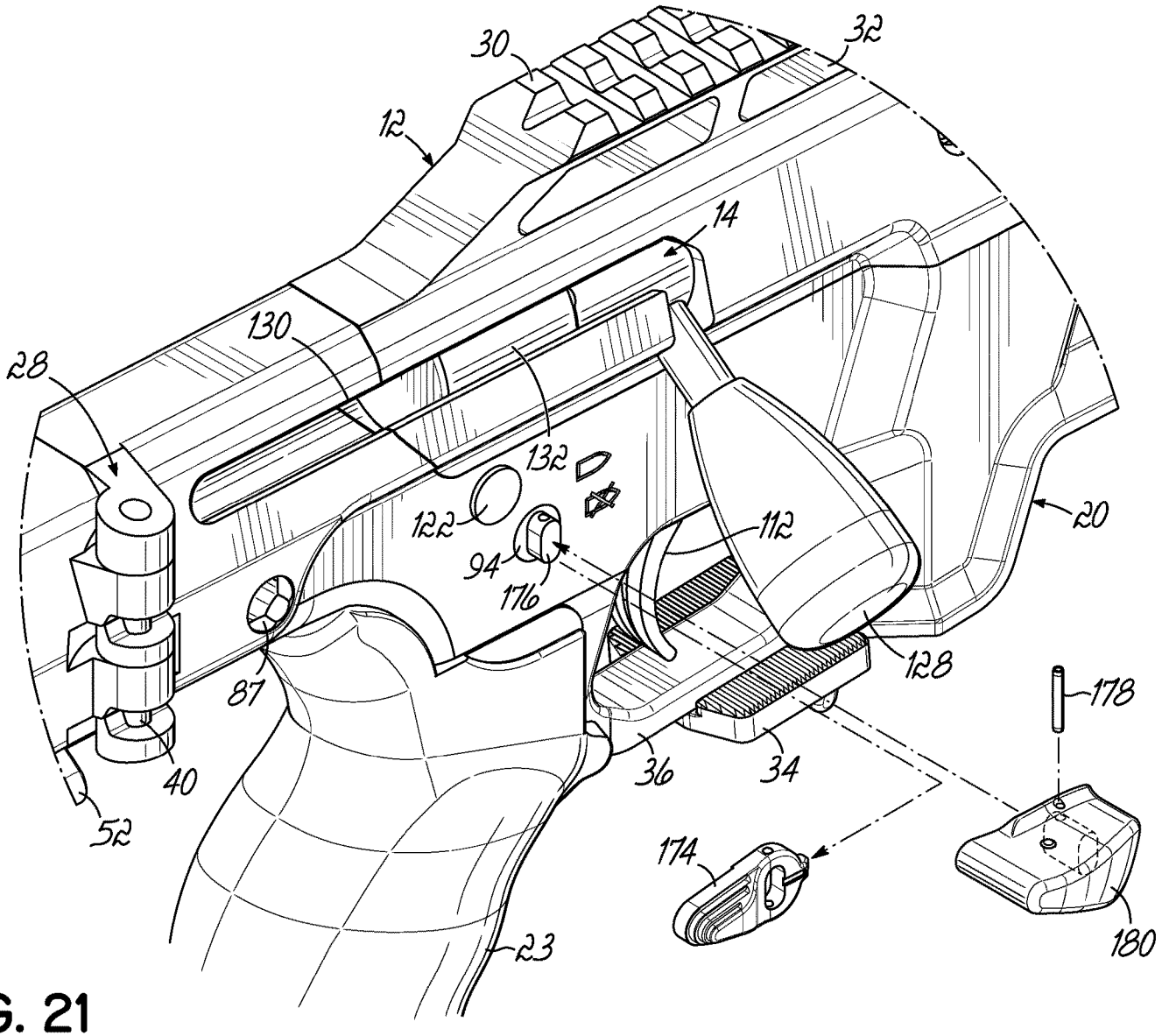
FIG. 21 is a partial isometric exploded view showing a thumb rest that can replace a safety selector lever.
Figure 22:
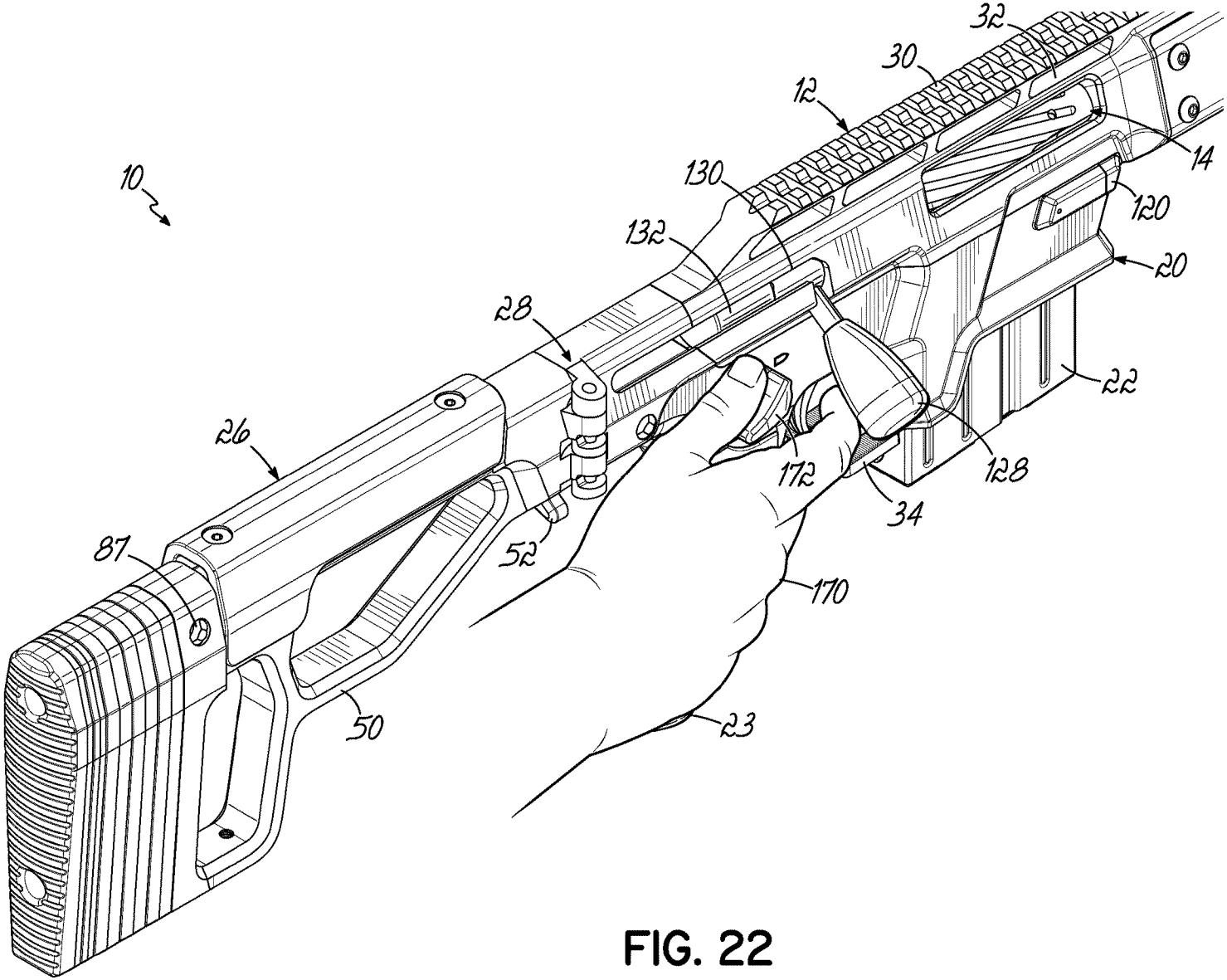
FIG. 22 is a partial isometric view showing placement of a user's hand on the grip and thumb rest.

Some precision marksmen prefer to grip a firearm 10 with their dominant (trigger finger) hand in a manner in which the shooter's thumb of that hand remains on the same side of the firearm 10 as the other fingers, rather than wrapping the web of the thumb around the backstrap of the grip 24. This can leave the user's thumb unsupported. FIGS. 21 and 22 illustrate a safety selector actuator/lever that is modified to provide a "strong side" thumb rest, Shown in FIG. 22 is a representation of a shooter's hand 170 depicted in phantom line in which the thumb of the dominant hand (in this case, the right hand) may be supported by the extended thumb rest 172, which replaces the actuation paddle or lever 174 of the safety selector switch 94, according to an embodiment of the invention. The thumb rest 172 includes a contact surface 180 presenting a shelf or support surface on or against which the user's thumb may be rested while gripping the firearm 10 in a shooting position. The extended thumb rest 172 also acts as a safety selector actuation paddle and may be provided on either or both sides of the lower receiver 20. The thumb rest 172 may be attached to a stem 176 of the safety selector switch 94 that engages a socket in the same manner as an ordinary detachable actuation lever 174, such as with an assembly cross pin 178.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A compound lever firearm trigger mechanism, comprising:

a first member pivotally attached to a firearm receiver at a first pivot and having a first lever arm extending away from the first pivot attachment point to a sear, the sear being movably mounted to the first member and being displaceable against a spring bias relative to the first member, the first member pivotable between a first position where the sear engages a firing element and a second position where the sear does not engage the firing element; and a trigger member pivotally attached to the first member first lever arm between the first pivot and the sear at a second pivot, the trigger member having a trigger blade arm extending away from the second pivot in one direction and a bearing arm extending away from the second pivot in another direction toward bearing contact with a surface of the receiver;

wherein a user applying pulling force to the trigger blade arm causes the trigger member to pivot relative to the first member and the bearing arm to move in bearing contact against the receiver, thereby pivoting the lever arm from the first position to the second position.

2. The trigger mechanism of claim 1, wherein the first member is spring biased toward the first position.

3. The trigger mechanism of claim 2, wherein the first member includes a second lever arm extending from the first pivot attachment point opposite the first lever arm, the second lever arm carrying a spring means extending toward contact with the receiver.

4. The trigger mechanism of claim 3, wherein tension of the spring means is adjustable.

5. The trigger mechanism of claim 1, wherein length of the bearing arm is adjustable.

6. The trigger mechanism of claim 1, wherein the firearm includes a trigger housing on which a safety selector is supported for rotation between safe and fire positions, the safety selector blocking movement of the first member when in the safe position.

7. The trigger mechanism of claim 6, wherein the safety selector includes an adjustment member that limits movement of the first member when the safety selector is in the fire position.

8. The trigger mechanism of claim 1, installed in combination with a receiver, a bolt, a barrel, and a stock.

* * * * *